US010894427B2

(12) United States Patent
Hirotani

(10) Patent No.: US 10,894,427 B2
(45) Date of Patent: Jan. 19, 2021

(54) PRINTER, PRINTING METHOD AND RECORDING MEDIUM

(71) Applicant: CASIO COMPUTER CO., LTD., Tokyo (JP)

(72) Inventor: Takayuki Hirotani, Akiruno (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/700,863

(22) Filed: Dec. 2, 2019

(65) Prior Publication Data

US 2020/0171867 A1 Jun. 4, 2020

(30) Foreign Application Priority Data

Dec. 3, 2018 (JP) ..... 2018-226217

(51) Int. Cl.
*B41J 3/36* (2006.01)
*B41J 29/393* (2006.01)

(52) U.S. Cl.
CPC ..... *B41J 3/36* (2013.01); *B41J 29/393* (2013.01)

(58) Field of Classification Search
CPC ..... B41J 3/36
See application file for complete search history.

(56) References Cited

U.S. PATENT DOCUMENTS

2007/0223982 A1 9/2007 Miller et al.
2016/0082719 A1* 3/2016 Harada ..... B41J 2/04505 347/14
2017/0280000 A1* 9/2017 Sukenori ..... H04N 1/23
2018/0178557 A1* 6/2018 Nakazawa ..... B41J 11/008

FOREIGN PATENT DOCUMENTS

JP 2852392 B2 2/1999
JP 2018-103475 A 7/2018

* cited by examiner

*Primary Examiner* — Matthew Luu
*Assistant Examiner* — Kendrick X Liu
(74) *Attorney, Agent, or Firm* — Fitch, Even, Tabin & Flannery LLP

(57) ABSTRACT

A printer includes a printer head, a sensor, and a processor. The printer head includes printing components. The sensor acquires data with respect to a distance by which the printer is moved in one of moving directions. The processor (i) adjusts a length of an image of a print subject so that the image of the print subject has a length two times a reference travel distance that is based on a distance acquired by the sensor, the distance acquired by the sensor being a distance by which the printer is moved from a starting position in a first moving direction, and (ii) controls the printer head in such a manner that, when the printer is moved in a second moving direction that is opposite to the first moving direction, the printer is made to print the adjusted image at the adjusted position of the image.

19 Claims, 16 Drawing Sheets

PRINTER, PRINTING METHOD AND RECORDING MEDIUM

CROSS-REFERENCE TO RELATED APPLICATION

This application claims the benefit of Japanese patent application No. 2018-226217 filed on Dec. 3, 2018, the entire disclosure of which is incorporated by reference herein.

FIELD

The present disclosure relates to a printer, a printing method and a recording medium.

BACKGROUND

Publically well-known printers include a manual scanning-type printer configured to print, on a print medium, a print subject such as a letter, a symbol, a mark or a pattern by manually moving the printer with its housing grasped.

A manual scanning-type printer described in U.S. Patent Application Publication No. 2007-0223982 including: a reference indicator disposed in the vicinity of the bottom of a housing; and a display to display a relative positional relationship between the reference indicator and an image to be printed. A user can know, using this printer, the relative positional relationship between the reference indicator and the image to be printed.

SUMMARY

In order to attain the aforementioned objective, a printer according to a first aspect of the present disclosure includes: a printer head including printing components that are arranged in a line in a first direction; a sensor to acquire data with respect to a distance by which the printer is moved in one of moving directions that intersect the first direction; and a processor configured (i) to adjust a length of an image of a print subject in the moving directions so that the image of the print subject has a length two times a reference travel distance, the reference travel distance being based on a distance acquired by the sensor, the distance acquired by the sensor being a distance by which the printer is moved from a starting position in a first moving direction of the moving directions, and (ii) to control the printer head in such a manner that, when the printer is moved in a second moving direction of the moving directions that is opposite to the first moving direction, the printer is made to print the adjusted image.

BRIEF DESCRIPTION OF THE DRAWINGS

A more complete understanding of this application can be obtained when the following detailed description is considered in conjunction with the following drawings, in which.

DETAILED DESCRIPTION

A printer (handy printer) according to an embodiment of the present disclosure is described below with reference to the drawings.

Figure 1:
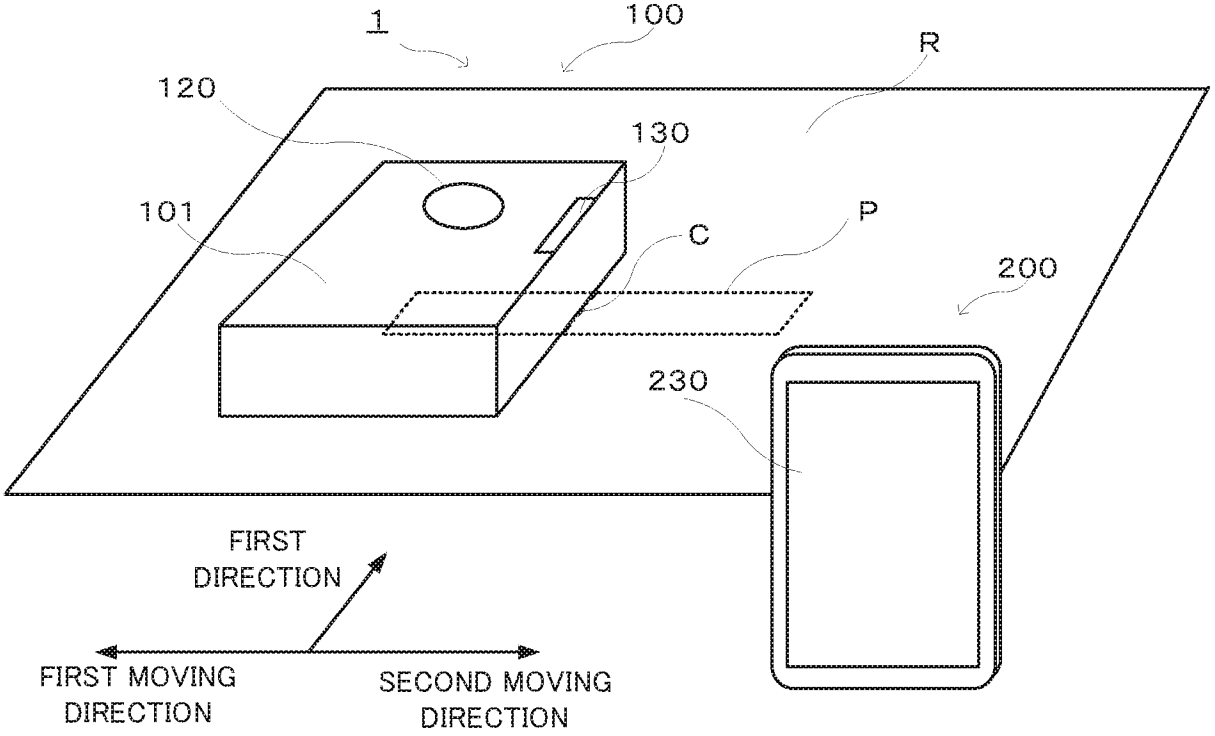
FIG. 1 is a view illustrating a handy printer and a terminal device according to an embodiment of the present disclosure.

As illustrated in FIG. 1, a handy printer 100 according to an embodiment of the present disclosure includes a housing 101 having a size enough for a user to easily grasp the housing by hand, and the handy printer 100 is configured to print subjects such as characters (including symbols, logos, icons, marks and the like), images, and patterns by moving the handy printer in a moving direction by the user. The handy printer 100 can easily print an image of the print subject on a print medium R in such a manner that (i) the image of the print subject is printed bilaterally evenly with respect to a central line C perpendicular to the moving directions and (ii) the image of the print subject has a size based on a printing position P at which printing the image of the print subject is scheduled. Data on the print subject printed by the handy printer 100 is transmitted from a terminal device 200. The terminal device 200 is a device including a display 230, such as a smartphone or a tablet personal computer (PC). The handy printer 100 and the terminal device 200 are configured to be able to wirelessly communicate with each other. The handy printer 100 and the terminal device 200 constitute a printing system 1.

Figure 2:
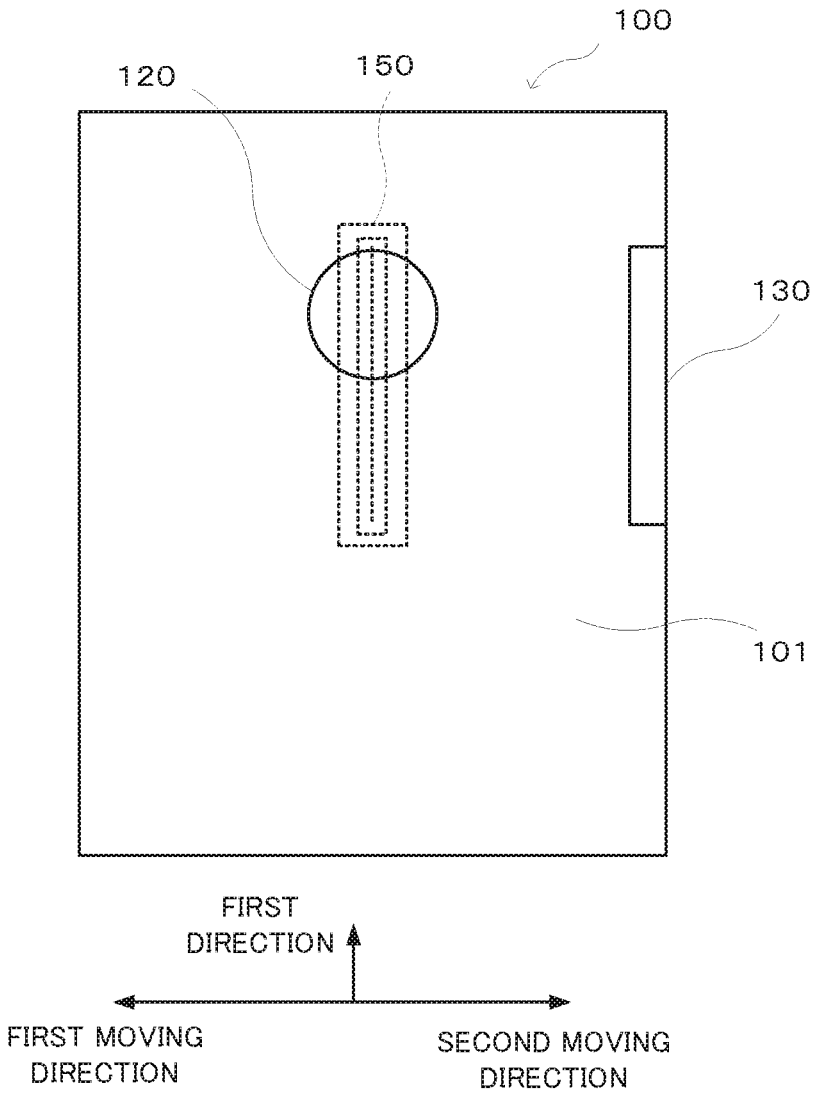
FIG. 2 is a top view illustrating the handy printer according to the embodiment of the present disclosure.

As illustrated in FIG. 2, the handy printer 100 includes: a determination button 120 to receive instructions to start printing the image of the print subject; and an indicator 130 to indicate a position at which the print subject is to be printed. In this embodiment, a surface on which the determination button 120 is disposed is regarded as the upper surface of the handy printer. The user presses the determination button 120 with the indicator 130 aligned with the central line C, moves the handy printer 100 in a first moving direction, presses the determination button 120 again, and moves the handy printer 100 in a second moving direction, thereby enabling the user to print the print subject bilaterally evenly with respect to the central line C. Also, a position at which the user presses the determination button 120 again corresponds to an edge of the print subject to be printed. In the embodiment, the phrase, "first moving direction", means a travel direction used for measuring a below-described reference travel distance, and the phrase, "second moving direction", means a direction in which the handy printer 100 is moved to print the print subject from left to right, and the second moving direction is the opposite direction to the first moving direction.

The indicator 130 is formed to extend in a direction parallel to a first direction of a below-described printer head 150. The indicator 130 indicates a reference position playing a role as a center of the print subject in the moving directions perpendicular to the first direction when the print subject is printed on the print medium R illustrated in FIG. 1. The indicator 130 includes: a light guide plate; a light emitting diode (LED) to emit red light; an LED to emit green light; and an LED to emit blue light, and the indicator 130 can emit any colors.

Figure 3:
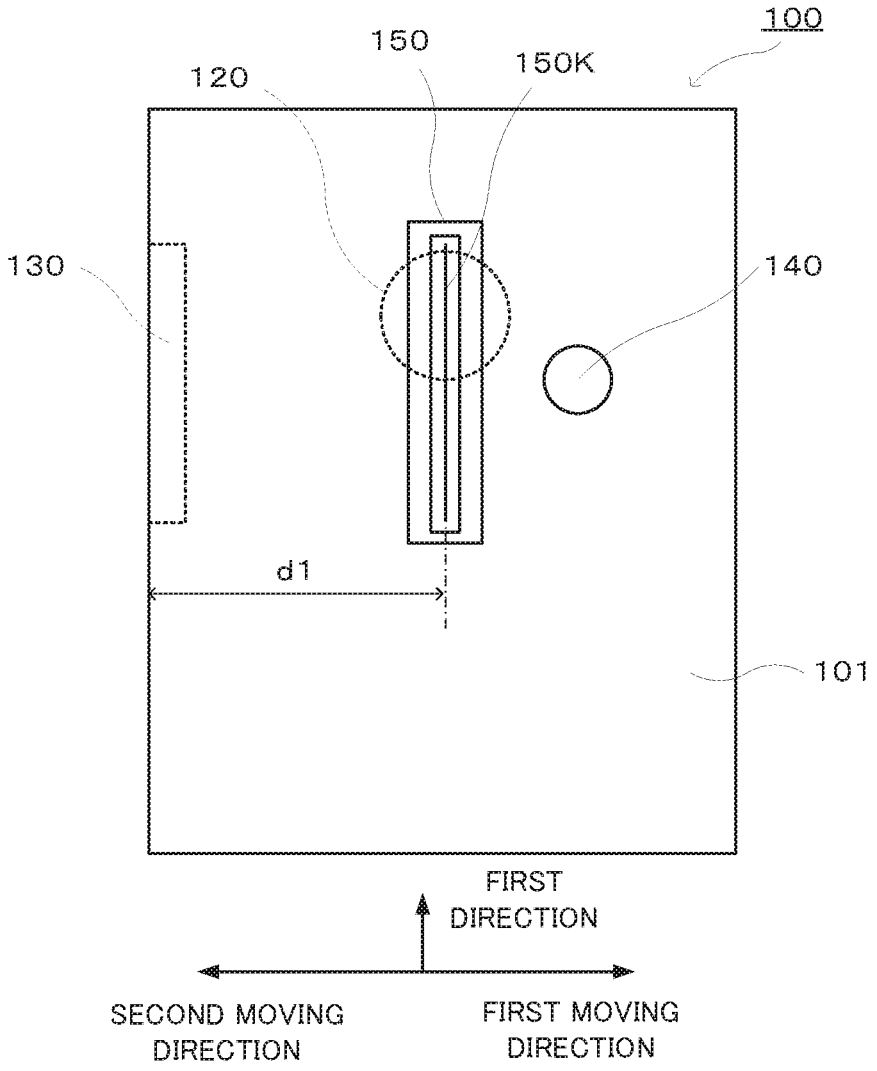
FIG. 3 is a bottom view illustrating the handy printer according to the embodiment of the present disclosure.

As illustrated in FIG. 3, a sensor 140 and the printer head 150 are disposed on the bottom surface of the handy printer 100.

The sensor 140 includes a light source such as an LED and an optical sensor and detects (acquires data with respect to) a distance by which the handy printer 100 is moved in one of the moving directions.

The printer head 150 includes a black-color printer head section 150K to eject black ink. The black-color printer head section 150K includes nozzles that are printing components, the number of the nozzles is n, and the nozzles are arranged in a line in the first direction. Electrical currents are selectively supplied to nozzles that is included in the above-described nozzles and that correspond to the shape of the print subject and, as a result, the printer head 150 ejects the ink from the nozzles corresponding to the shape of the print subject. The black-color printer head section 150K is arranged at a position at which a distance between the black-color printer head section 150K and the indicator 130 is dl.

Figure 4:
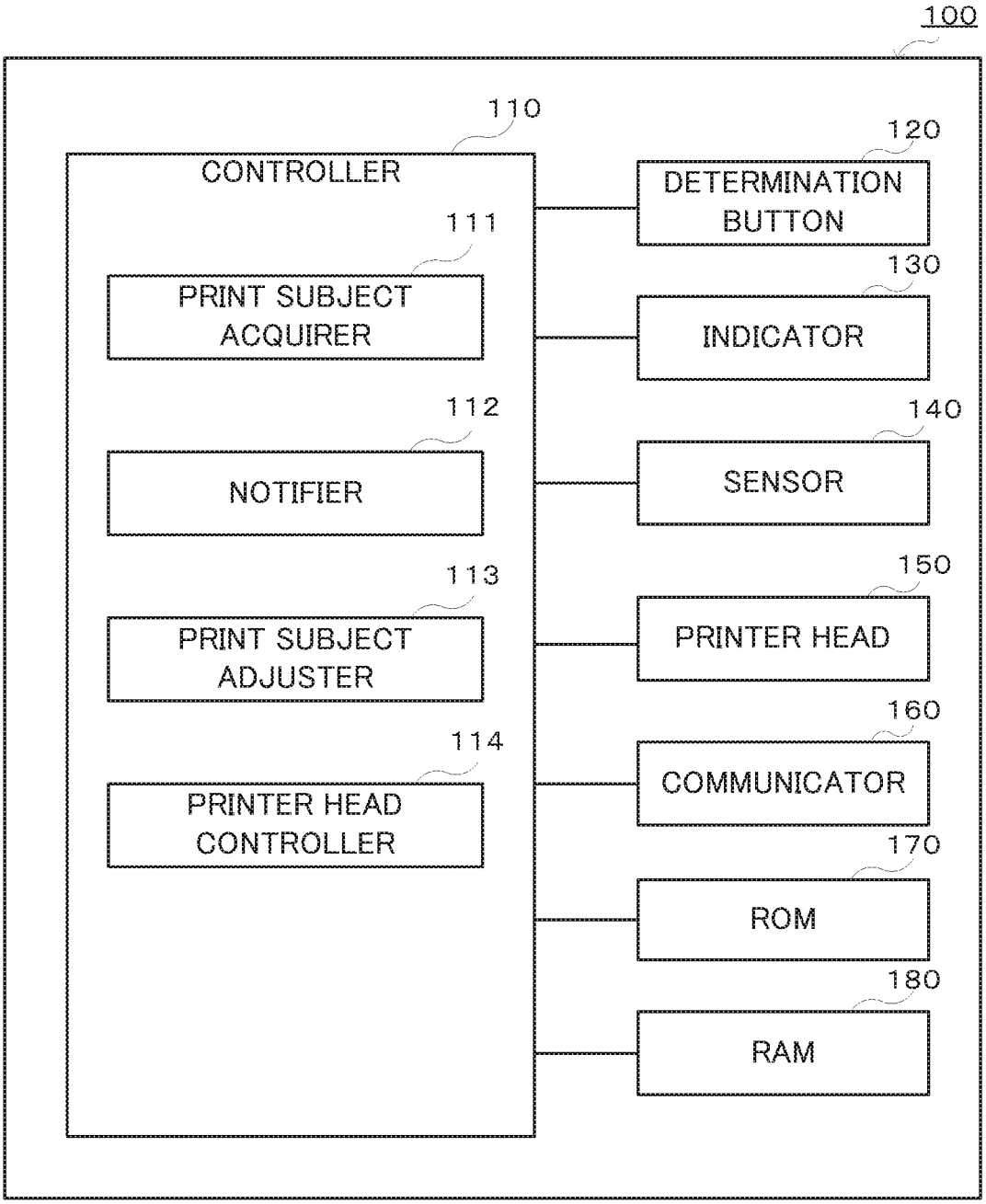
FIG. 4 is a block diagram illustrating a configuration of the handy printer according to the embodiment of the present disclosure.

As illustrated in FIG. 4, as an electrical configuration of the handy printer 100, the handy printer 100 includes a controller 110, a communicator 160, a read only memory (ROM) 170 and a random access memory (RAM) 180 in addition to the determination button 120, the indicator 130, the sensor 140 and the printer head 150 that are described above.

The controller 110 is a processor such as a central processing unit (CPU). The controller 110 executes a program stored in the ROM 170. As a result, the controller 110 functions as a print subject acquirer 111, a notifier 112, a print subject adjuster 113 and a printer head controller 114.

The print subject acquirer 111 acquires data on the print subject and data on an initial length that are transmitted from the terminal device 200 via the communicator 160, and then the print subject acquirer 111 stores the data on the print subject and the data on the initial length in the RAM 180.

The notifier 112 causes the indicator 130 to emit light and notifies the user of a start of printing, a completion of printing, an operation state of the printer and the like. Upon acquiring the data on the print subject by the print subject acquirer 111, the print subject acquirer 111 is put on standby for printing, and then the notifier 112 causes the indicator 130 to emit white light. Upon pressing the determination button 120 and determining that a distance by which the handy printer is moved is larger than a below-described first reference distance, the notifier 112 causes the indicator 130 to changes the white light to emit green light to notify the user that printing the print subject is possible. Also, upon determining that the distance by which the handy printer is moved is larger than a below-described second reference distance, the notifier 112 causes the indicator 130 to changes the white light to emit red light to notify the user that the reference travel distance is beyond an upper limit value. The first reference distance is a lower limit value of reference travel distance for preventing a printed image of the print subject from having a too small size. The second reference distance is an upper limit value of reference travel distance for preventing a printed image of the print subject from being excessively expanded to be too long in the moving directions to print the image of the print subject. As a result, an adjusted image of the print subject that is not too short or too long in the moving directions can be printed. Upon finishing printing the print subject, the notifier 112 causes the indicator 130 to emit blue light and, afterward, the indicator 130 stops emitting the blue light.

The print subject adjuster 113 (i) calculates the first reference distance and the second reference distance based on the initial length of the image of the print subject and (ii) adjusts, based on the reference travel distance, at least one of a printing area of the image of the print subject, a printing position of the image, and a size of the image. For example, the size of the image of the print subject is adjusted such that the length of the image of the print subject in the first direction is unchanged and the length of the image of the print subject in the moving directions is increased to be two times the reference travel distance. The term, "initial length", means an original length of the image of the print subject in the moving directions. Also, the term, "reference travel distance", means a distance used as a criterion for determining a length of an adjusted image of the print subject in the moving directions. The reference travel distance is a distance by which the user moves the handy printer 100 in the first moving direction from a time when the indicator 130 is aligned with the central center C of the printing position P and the determination button is pressed to a time when the determination button is pressed again. As a result, an adjusted image of the print subject can be obtained that enables the print subject to be printed bilaterally evenly with respect to the central line C. The print subject adjuster 113 stores, in the RAM 180, at least one of a printing area of the image of the print subject, a printing position of the image, and a size of the image.

The printer head controller 114 controls the printer head 150 so that the print subject the image of which is adjusted by the print subject adjuster 113 is printed on the print medium R. Specifically, the printer head controller 114 controls the printer head 150 such that one dot line of the adjusted image of the print subject is printed as often as the handy printer 100 is made to move a distance corresponding to one dot pitch.

The determination button 120 receives, based on operation by the user, instructions to start printing the print subject in the first moving direction or to stop printing the print subject.

As described above, the sensor 140 (i) detects a travel distance that is a distance by which the printer head 150 is moved relative to the print medium R and (ii) outputs, to the controller 110, data on the detected travel distance.

As described above, on the basis of the control by the printer head controller 114, the printer head 150 selectively ejects ink from the nozzles of the printer head 150 in accordance with data on printing as often as the handy printer 100 is made to move the distance corresponding to one dot pitch in the moving directions. The ejected ink is adhered to the print medium R and thus pixels (one dot line) are printed that align with one another in the first direction of the printer head 150.

The communicator 160 receives, from the terminal device 200, data on the print subject and data on the initial length. The communicator 160 is a wireless communication module such as a wireless local area network (LAN) or Bluetooth (registered trademark).

The ROM 170 is a nonvolatile memory such as a flash memory and stores a program for causing the controller 110 to perform various functions, the distance dl between the black-color printer head section 150K and the indicator 130, and the like. The RAM 180 is a volatile memory and is used as a working area for executing the program for causing the controller 110 to perform various processes. Additionally, the RAM 180 stores the data on the print subject, the data on the initial length, and data on the adjusted image of the print subject that are transmitted from the terminal device 200.

Figure 5:
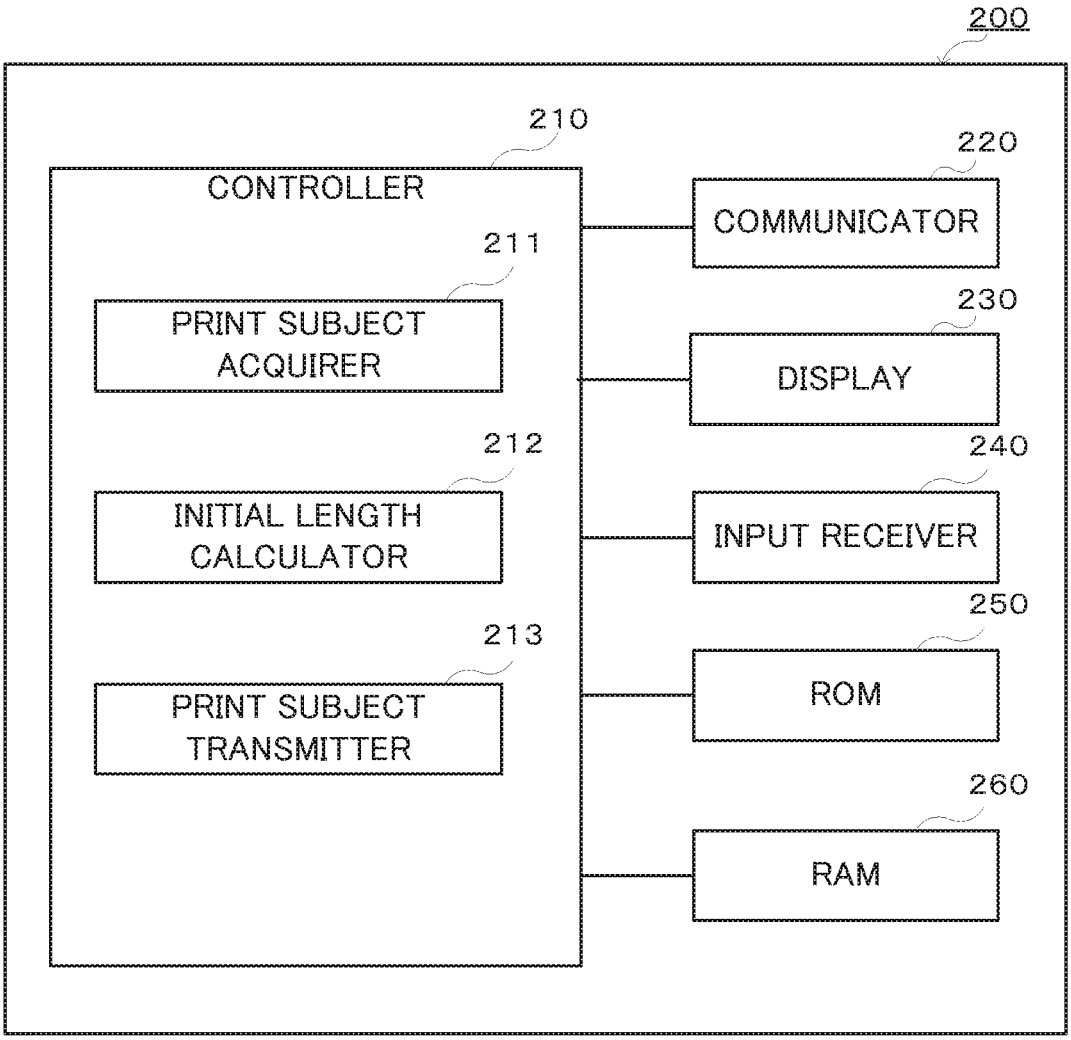
FIG. 5 is a block diagram illustrating a configuration of the terminal device according to the embodiment of the present disclosure.

As illustrated in FIG. 5, the terminal device 200 includes a controller 210, a communicator 220, a display 230, an input receiver 240, a ROM 250, and a RAM 260.

The controller 210 is a processor such as a CPU. The controller 210 executes a program stored in the ROM 250 to function as a print subject acquirer 211 and an initial length calculator 212 and a print subject transmitter 213.

The print subject acquirer 211 acquires the data on the print subject received by the input receiver 240 or by the communicator 220.

The initial length calculator 212 calculates the initial length of the print subject in the moving directions and displays a calculated value of the initial length on the display 230. For example, in a case in which the print subject includes letters, the initial length calculator 212 calculates, based on the sizes of the letters, the number of the letters or the like, the initial length of the print subject in the moving directions. In a case in which the print subject is a picture, the initial length calculator 212 calculates the initial length based on the number of pixels in the moving directions.

The print subject transmitter 213 transmits, to the handy printer 100 via the communicator 220, the data on the print subject and the data on the initial length.

The communicator 220 transmits, to the handy printer 100, the data on the print subject and the date on the initial length. Like the communicator 160 described above, the communicator 220 is a wireless communication module such as a wireless local area network (LAN) or Bluetooth (registered trademark).

The display 230 is a device to display an image of the inputted print subject and an image necessary for manipulation of the terminal device, such as a liquid crystal display (LCD).

The input receiver 240 receives, based on user's input, the data on the print subject, instructions to start printing the print subject, and instructions to stop printing the print subject. The input receiver 240 and the display 230 constitute a touch-screen display device.

The ROM 250 is a nonvolatile memory such as a flash memory and stores a program for causing the controller 210 to perform various functions. The RAM 260 is a volatile memory and is used as a working area for executing the program for causing the controller 210 to perform various processes. Also, the RAM 260 stores the data on the print subject.

Next, when the terminal device 200 and the handy printer 100 have the above-described structures, transmission processing performed by the terminal device 200 and printing processing performed by the handy printer 100 are described. In this case, the user presses the determination button 120 with the indicator 130 aligned with the central line C illustrated in FIG. 1, moves the handy printer 100 in the first sb-scanning direction, and presses the determination button 120 again, thereby enabling the print subject to be printed bilaterally evenly with respect to the central line C. Also, an end portion of the print subject is printed at a position at which the determination button 120 is pressed again.

Figure 6:
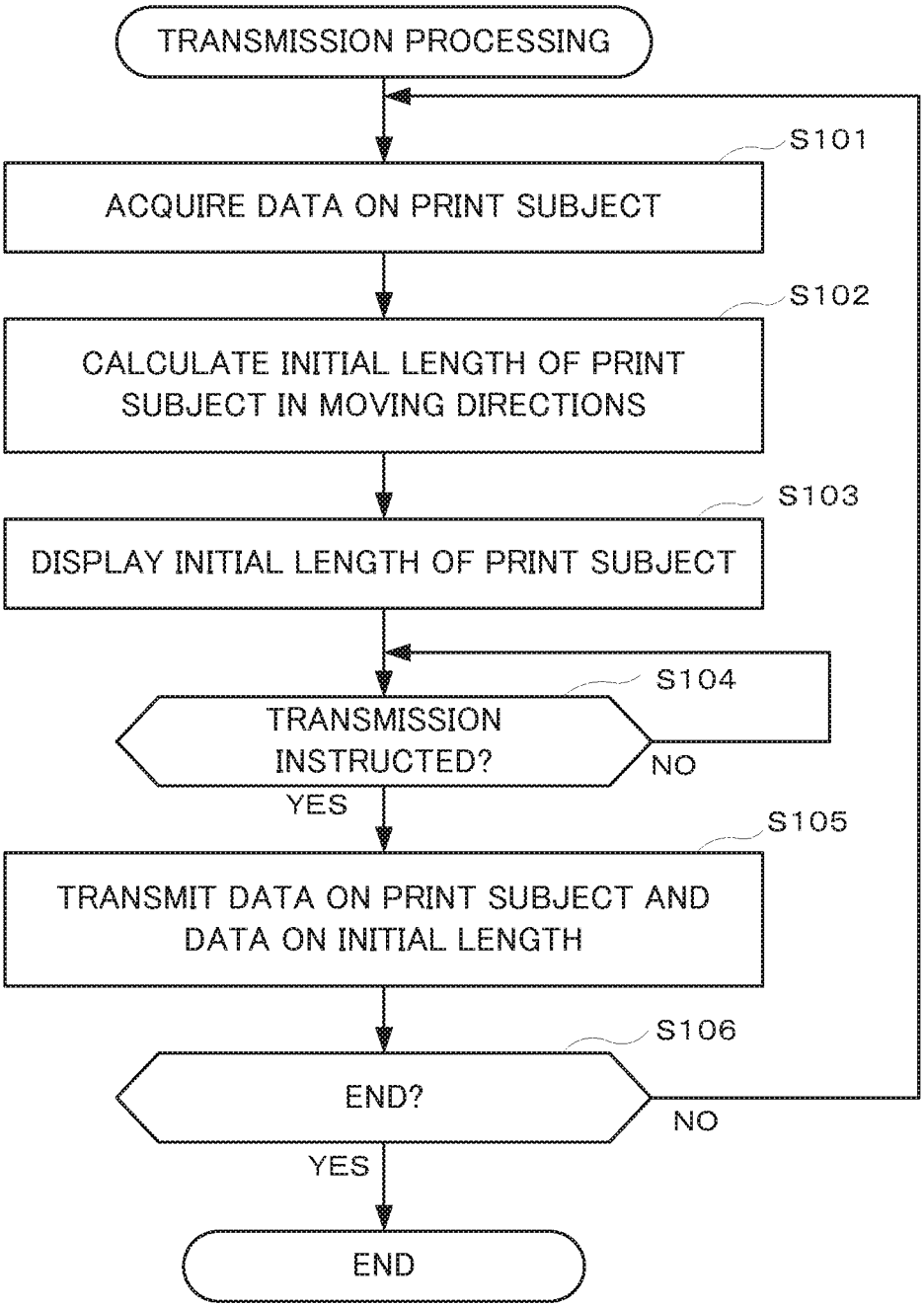
FIG. 6 is a flow chart illustrating data transmission processing executed by the terminal device according to the embodiment of the present disclosure.

The terminal device 200 responds to the user's instructions to start the transmission processing and starts performing the transmission processing illustrated in FIG. 6. The handy printer 100 responds to the user's instructions to start the printing processing and starts performing the printing processing illustrated in FIG. 7. The transmission processing performed by the terminal device 200 and the printing processing performed by the handy printer 100 are described below with reference to the flow charts.

As illustrated in FIG. 6, the print subject acquirer 211 receives the data on the print subject that is inputted into the input receiver 240 (step S101). The print subject acquirer 211 stores, in the RAM 260, the received data on the print subject. Subsequently, the initial length calculator 212 calculates the initial length of the print subject in the moving directions (step S102). For example, in a case in which the print subject includes letters, the initial length calculator calculates, based on the sizes of the letters, the number of the letters and the like, the initial length of the print subject in the moving directions. Subsequently, the initial length calculator 212 displays, on the display 230, the initial length of the print subject (step S103). Next, the print subject transmitter 213 determines whether instructions to transmit the data on the print subject and the data on the initial length are received by the print subject transmitter (step S104). In a case in which the data on the print subject or the data on the initial length is not received by the print subject transmitter (NO in step S104), step S104 is repeated. In a case in which the data on the print subject and the data on the initial length are received by the print subject transmitter (YES in step S104), the print subject transmitter 213 transmits, to the handy printer 100 via the communicator 220, the data on the print subject and the data on the initial length (step S105).

Subsequently, the print subject transmitter determines whether instructions to finish the print subject transmission processing are inputted (step S106). In a case in which the instructions to finish the print subject transmission processing are not inputted (NO in step S106), the print subject transmission processing returns to step S101 and steps S101 to S106 are repeated. In a case in which the instructions to finish the print subject transmission processing are inputted (YES in step S106), the print subject transmission processing is finished.

Figure 7:
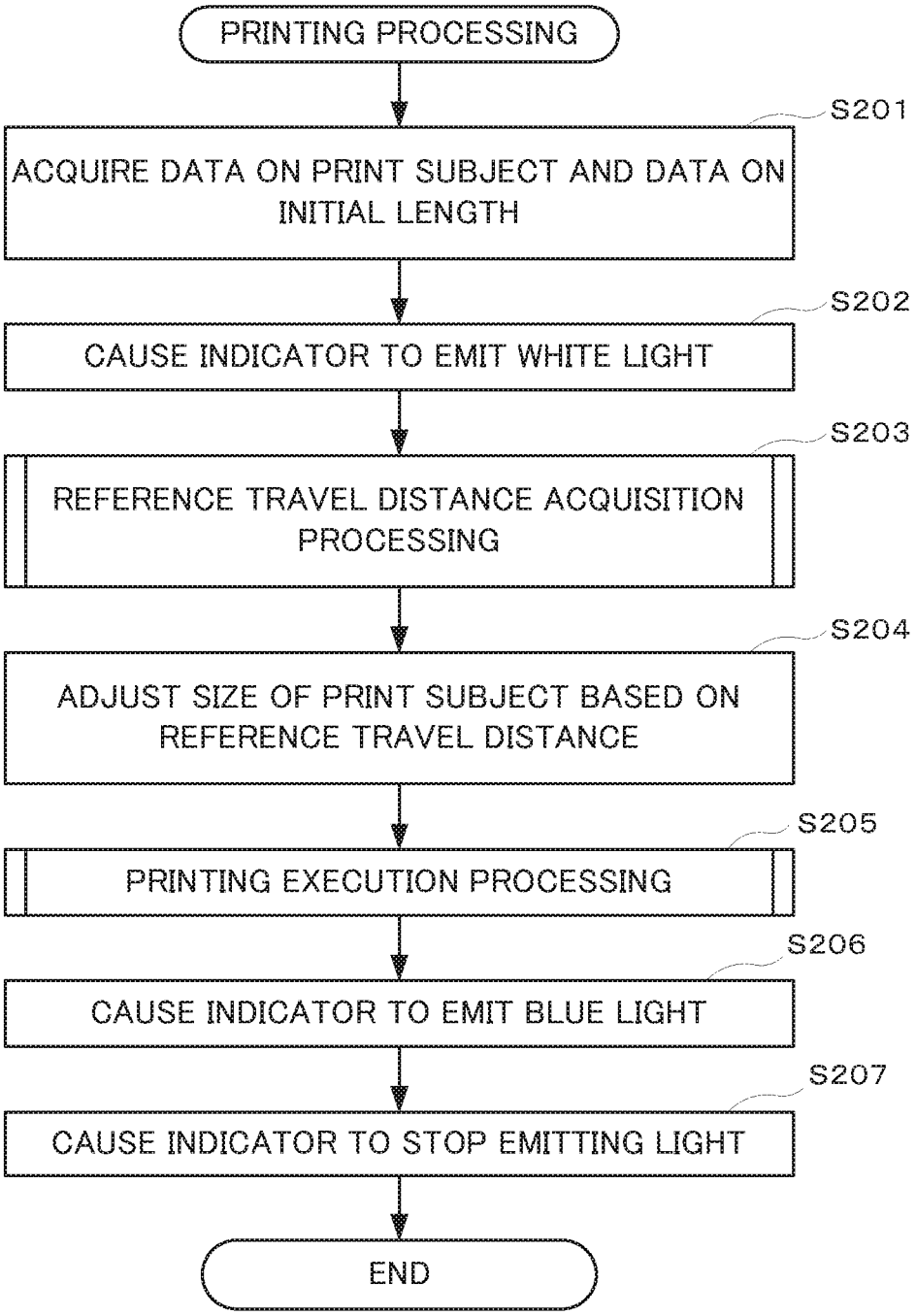
FIG. 7 is a flow chart illustrating printing processing executed by the handy printer according to the embodiment of the present disclosure.

Upon transmitting from the terminal device 200 the data on the print subject and the data on the initial length, as illustrated in FIG. 7, the print subject acquirer 111 of the handy printer 100 acquires, via the communicator 160, the data on the print subject and the data on the initial length and stores, in the RAM 180, the data on the print subject and the data on the initial length (step S201). Next, the notifier 112 causes the indicator 130 to emit white light (step S202) to notify the user that the handy printer 100 is in a standby state for printing the print subject. Thereafter, the print subject adjuster 113 of the handy printer 100 executes reference travel distance acquisition processing with the indicator 130 aligned with the central line C of the printing position P by the user (step S203).

Figure 8:
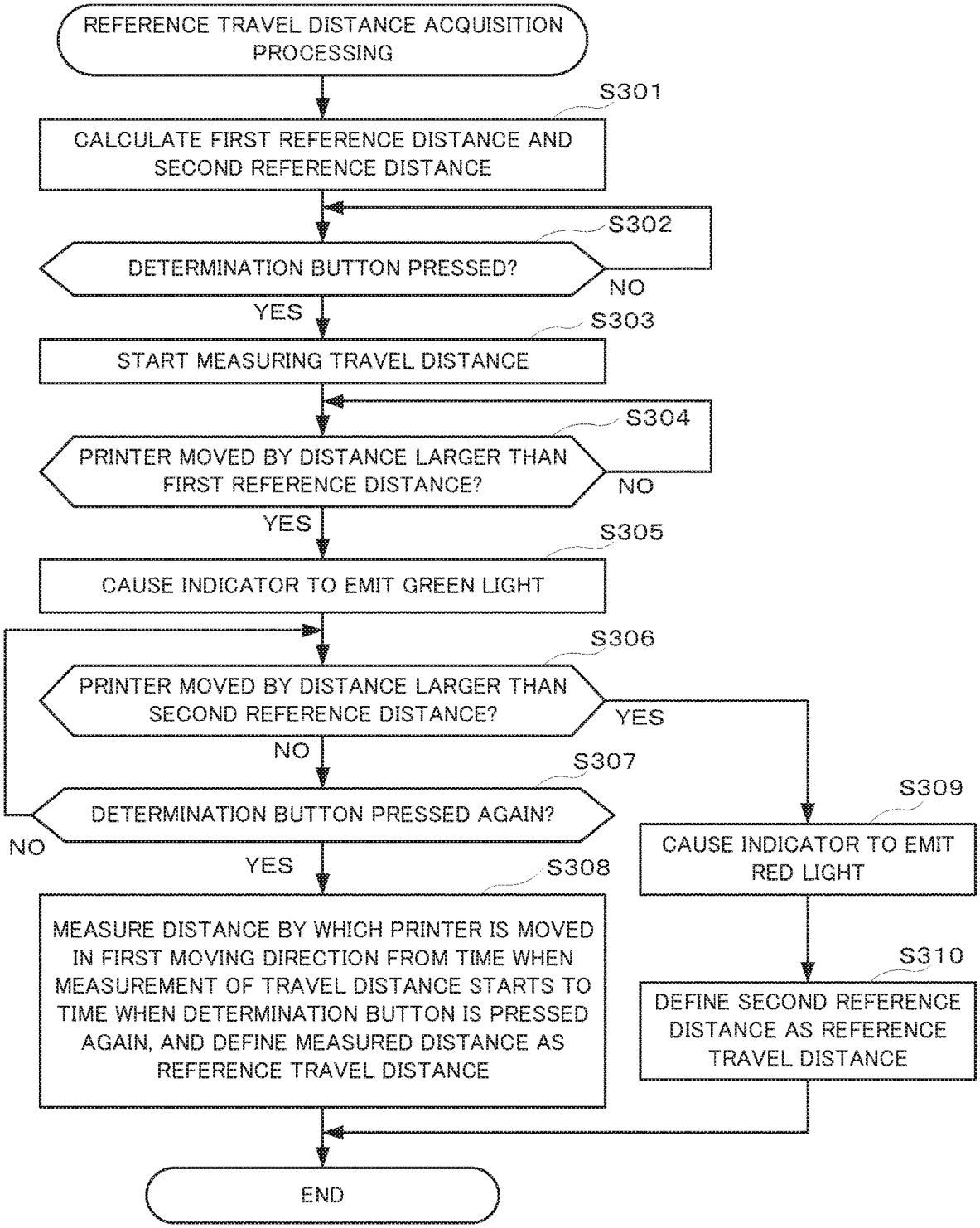
FIG. 8 is a flow chart illustrating reference travel distance acquisition processing executed by the handy printer according to the embodiment of the present disclosure.

As illustrated in FIG. 8, the print subject adjuster 113 calculates a first reference distance and a second reference distance (step S301). The first reference distance and the second reference distance are calculated based on the initial length of the print subject. The first reference distance is the lower limit value of the reference travel distance for preventing a printed image of the print subject from having a too small size and the second reference distance is the upper limit value of the reference travel distance for preventing a printed image of the print subject from being excessively expanded to have a too long length in the moving directions. As a result, the print subject can be printed that is adjusted to prevent the print subject from having too long or too short length in the moving directions. For example, the first reference distance is set to a length that is one-fourth of the initial length and the second reference distance is set to a length that is equal to the initial length, thereby enabling an printed image of the print subject adjusted in the moving directions to have a length that is not less than one-half of the initial length and that is not larger than a length two times the initial length.

Next, the print subject adjuster 113 determines whether the determination button 120 is pressed (step S302). As long as the print subject adjuster 113 determines that the determination button 120 is not pressed (NO in step S302), step 302 is repeated. When the print subject adjuster 113 determines that the determination button 120 is pressed by the user (YES in step S302), the print subject adjuster 113 controls the sensor 140 to cause the sensor 140 to start measuring a travel distance by which the handy printer 100 is moved in the first moving directions (step S303) and determines whether the travel distance by which the handy printer 100 is moved in the first moving direction is equal to or larger than the first reference distance (step S304). In a case in which the print subject adjuster determines that the travel distance by which the handy printer 100 is moved in the first moving direction is less than the first reference distance (NO in step S304), the print subject adjuster repeats step S304. In a case in which the print subject adjuster determines that the travel distance by which the handy printer 100 is moved in the first moving direction is equal to or larger than the first reference distance (YES in step S304), the notifier 112 causes the indicator 130 to change the emitted light to green light (step S305).

Subsequently, the print subject adjuster determines whether the travel distance by which the handy printer 100 is moved in the first moving direction is equal to or larger than the second reference distance (step S306). In a case in which the print subject adjuster determines that the travel distance by which the handy printer 100 is moved in the first moving direction is less than the second reference distance (NO in step S306), the print subject adjuster 113 determines whether the determination button 120 is pressed again (step S307). In a case in which the print subject adjuster determines that the determination button 120 is not pressed again (NO is step S307), the reference travel distance acquisition processing returns to step S306, and steps S306 and S307 are repeated. In a case in which the print subject adjuster determines that the determination button 120 is pressed again (YES in step S307), the print subject adjuster 113 sets, to the reference travel distance, a distance detected by the sensor 140 from a time when the determination button 120 is pressed in step S302 to a time when the determination button 120 is pressed again in step S307 (step S308). In a case in which the print subject adjuster determines that the travel distance by which the handy printer 100 is moved in the first moving direction is equal to or larger than the second reference distance (YES in step S306), the notifier 112 causes the indicator 130 to change the emitted light to red light (step S309). The print subject adjuster 113 defines the second reference distance as the reference travel distance (step S310) and finishes the reference travel distance acquisition processing, and the handy printer 100 returns to the printing processing illustrated in FIG. 7.

The print subject adjuster 113 adjusts, based on the reference travel distance, the size of the image of the print subject (step S204). Specifically, the print subject adjuster 113 adjusts the size of the image of the print subject so that the image of the print subject has (i) a length equal to the original length of the image of the print subject in the first direction and (ii) a length two times the reference travel distance in the moving direction. As a result, the adjusted image of the print subject can be printed that is blown up or shrunk in the moving directions. Next, the printer head controller 114 executes printing execution processing in which the adjusted image of the print subject is printed on the print medium (step S205).

Figure 9:
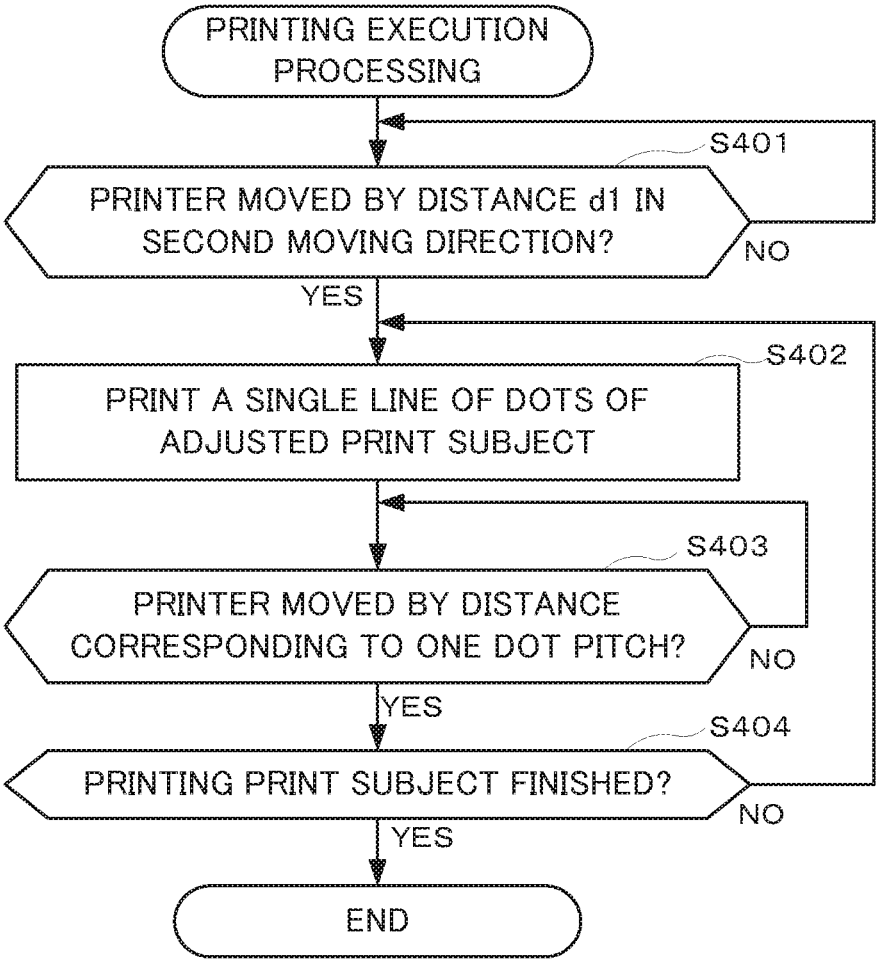
FIG. 9 is a flow chart illustrating printing execution processing executed by the handy printer according to the embodiment of the present disclosure.

Upon starting the printing execution processing, as illustrated in FIG. 9, the printer head controller 114 determines whether the handy printer is moved by the distance dl in the second moving direction (step S401). As a result, printing of the print subject is started at the position at which the indicator 130 is located when the determination button is pressed again. Step S401 is repeated until the handy printer is moved by the distance dl in the second moving direction (NO in step S401). Upon moving the handy printer by the distance dl in the second moving direction (YES in step S401), a single line of dots of the adjusted image of the print subject is printed (step S402). The printer head controller 114 determines whether the handy printer is moved by a distance corresponding to one dot pitch (step S403). If the printer head controller 114 determines that the handy printer is not yet moved by a distance corresponding to one dot pitch (No in step S403), the step S403 is repeated.

If the printer head controller determines that the handy printer is moved by the distance corresponding to one dot pitch (YES in step S403), the printer head controller determines whether printing of the adjusted image of the print subject is finished (step S404). If the printer head controller determines that printing of the adjusted image of the print subject is not yet finished (No in step S404), the printer header controller causes the processing to return to steps S402 and the step S420 to S404 are repeated. The repeats of the steps S402 to S404 cause the handy printer to print a single line of dots of the image of the print subject as often as the handy printer is moved by a distance corresponding to one dot pitch. If the printer head controller determines that printing of the adjusted image of the print subject is finished (YES in step S404), the printer head controller stops the printing execution processing and the handy printer returns to the printing processing illustrated in FIG. 7.

Upon finishing printing all of portions of the print subject, the notifier 112 causes the indicator 130 to emit blue light (step S206). Afterward, the indicator 130 is made to stop emitting the light (step S207), and the printing process is finished.

Next, the printing processing performed by the handy printer 100 according to the present embodiment of the present disclosure and the transmission processing performed by the terminal device 200 are described based on an concrete example and with reference to FIGS. 10 to 13.

Figure 10:
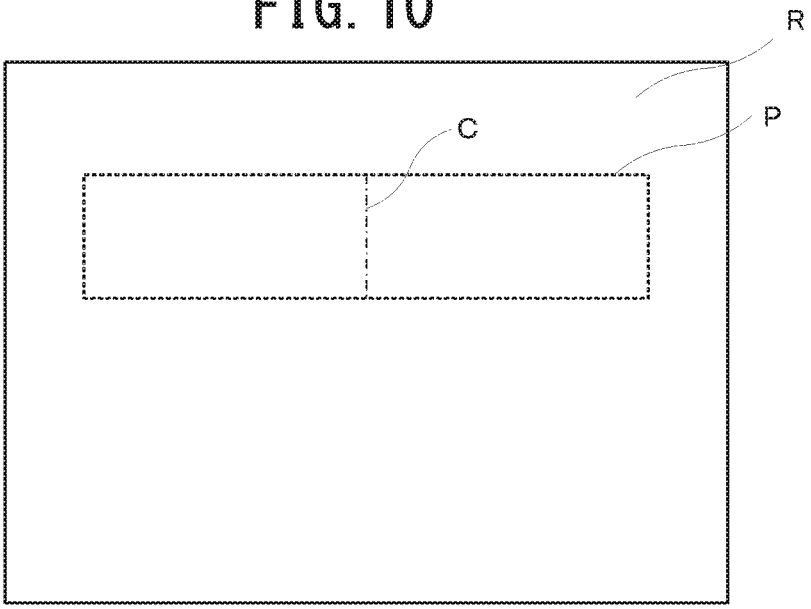
FIG. 10 is a view illustrating the printing processing executed by the handy printer according to the embodiment of the present disclosure.

After the user aligns the indicator 130 of the handy printer 100 with the central line C of the printing position P illustrated in FIG. 10 and presses the determination button 120, the user moves the handy printer 100 to an end portion of the printing position P in the first moving direction, presses the determination button 120 again, and moves the handy printer 100 in the second moving direction. As a result, the central portion of the print subject is printed on the central line C of the printing position P. An example described below is a case in which the central portion of letters "A B C" that are the print subject is aligned with the central line C of the printing position P of the print medium R and then is printed on the print medium.

First, the handy printer 100 responds to user's instructions to start the printing processing and then starts the printing processing, and the terminal device 200 starts the transmission processing. Upon starting the print subject transmission processing by the terminal device 200, the print subject acquirer 211 acquires data on print subject inputted to the input receiver 240 (step S101 in FIG. 6). At this point, the print subject acquirer 211 acquires, as the print subject, the letters "A B C" inputted by the user. Next, the initial length calculator 212 calculates the initial length of the print subject in the moving directions (step S102 in FIG. 6) and displays the calculated initial length of the print subject on the display 230 (step S103 in FIG. 6). As a result, the user can know the length of an image of the print subject and thus can determine whether the print subject can be printed at the printing position P. Upon receiving instructions to transmit the data (YES in step S104 in FIG. 6), the print subject transmitter 213 transmits, to the handy printer 100 via the communicator 220, data on the print subject and data on the initial length (step S105 in FIG. 6). Afterward, upon inputting instructions to finish the transmission processing (YES in step S106 in FIG. 6), the transmission processing is finished.

Upon transmitting from the terminal device 200 the data on the print subject and the data on the initial length, the print subject acquirer 111 of the handy printer 100 acquires the date on the print subject and the data on the initial length that are transmitted from the terminal device 200, and then the print subject acquirer 111 stores, in the RAM 180, the data on the print subject and the data on the initial length (step S201 in FIG. 7). Next, the notifier 112 causes the indicator 130 to emit the white light (step S202 in FIG. 7) to notify the user that the handy printer 100 is in the standby state for printing the print subject. Next, the print subject adjuster 113 executes the reference travel distance acquisition processing (step S203 in FIG. 7).

Figure 11:
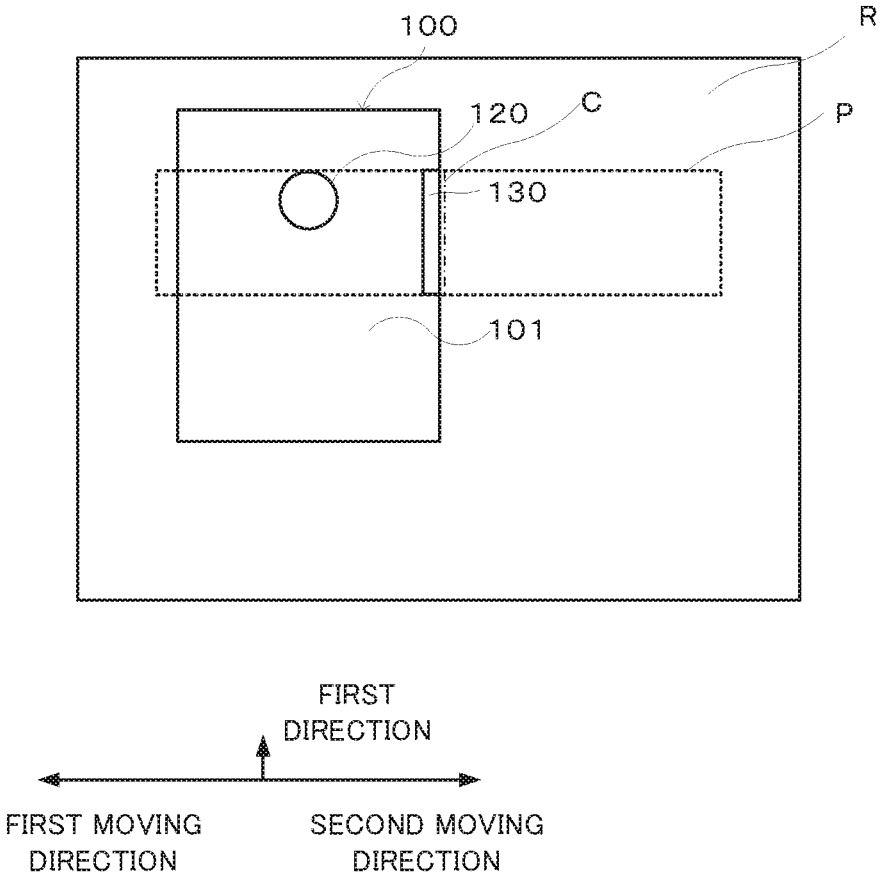
FIG. 11 is a view illustrating the printing processing executed by the handy printer according to the embodiment of the present disclosure.
Figure 12:
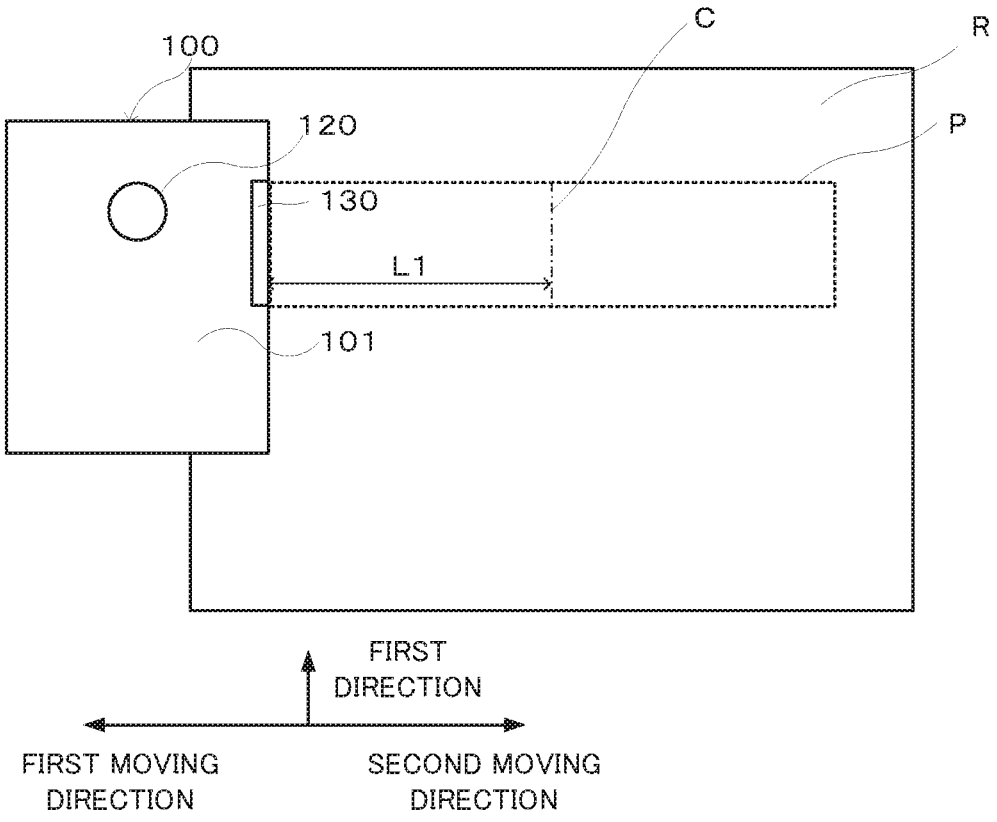
FIG. 12 is a view illustrating the printing processing executed by the handy printer according to the embodiment of the present disclosure.

The print subject adjuster 113 calculates the first reference distance and the second reference distance (step S301 in FIG. 8). As illustrated in FIG. 11, upon aligning the indicator 130 with the central line C of the printing position P and pressing the determination button 120 by the user (YES in step S302 in FIG. 8), the print subject adjuster 113 controls the sensor 140 to cause the sensor 140 to start measuring the travel distance by which the handy printer is move in the first moving direction (step S303 in FIG. 8). Next, if the travel distance by which the handy printer 100 is moved is equal to or larger than the first reference distance (YES in step S304 in FIG. 8), the notifier 112 causes the indicator 130 to change the emitted light to the green light (step S305 in FIG. 8). As a result, the user can know that the handy printer 100 is moved by a distance equal to or larger than the first reference distance that is the lower limit value of the reference travel distance. As illustrated in FIG. 12, when the user moves the handy printer 100 in the first moving direction so that the indicator 130 is located at the end portion of the printing position P and then the user presses the determination button 120 again (YES in step S307 in FIG. 8), the sensor 140 detects the travel direction by which the handy printer is moved from the time when the determination button 120 is pressed in step S302 to the time when the determination button 120 is pressed again in step S307, and then the sensor 140 defines the travel direction as the reference travel distance L1 (step S308 in FIG. 8).

The print subject adjuster 113 adjusts, based on a reference travel distance L1 detected by the sensor 140, the size of the image of the print subject (step S204 in FIG. 7). Specifically, the length of the image of the print subject in the first direction is unchanged and the length of the image of the print subject in the moving direction is adjusted such that the length of the image of the print subject in the moving direction is increased to be a distance two times the reference travel distance L1. By such adjustment, the adjusted image of the print subject can be obtained that fits the size of the printing position P. Next, the printer head controller 114 executes the printing execution processing in which the adjusted image of the print subject is printed (step S205 in FIG. 7).

Upon starting the printing execution processing to move the handy printer 100 by the distance dl in the second moving direction (YES in step S401 in FIG. 9), a single line of dots of the adjusted image of the print subject is printed (step S402). Upon moving the handy printer 100 by a distance corresponding to one dot pitch of dots of the image of the print subject (YES in step S403), the printer head controller determines whether printing the adjusted image of the print subject is finished (step S404). If the printer head controller determines that printing the adjusted image of the print subject is not finished (NO in step S404), the printer head controller causes the processing to return to step S402, and steps S402 to S404 are repeated until printing the adjusted image of the printed image is finished. When the user moves the handy printer 100 to the position illustrated in FIG. 13, the printer head controller determines that printing the adjusted image of the printed image is finished (YES in step S404) and the printer head controller stops the printing execution processing, and the notifier 112 causes the indicator 130 to emit the blue light (step S206). Afterward, the indicator 130 stops emitting the light (step S207) and thus the printing processing is finished.

As described above, in the handy printer 100 of the present embodiment, the sensor 140 detects the reference travel distance L1, and the print subject adjuster 113 adjusts, based on the reference travel distance L1, the size of the image of the print subject, thereby obtaining the adjusted image of the print subject that fits the size of the printing position P. Additionally, the indicator 130 is aligned with the central line C of the printing position P, the handy printer is moved by the reference travel distance L1 in the first moving direction, and then the handy printer is moved in the second moving direction. As a result, the adjusted image of the print subject is printed in such a manner that the center portion of the printed image of the print subject is located on the central line C of the printing position P. Additionally, if the print subject adjuster determines that the travel distance by which the handy printer is moved is equal to or larger than the first reference distance, the notifier 112 causes the indicator 130 to change the emitted light to the green light, thereby enabling the user to know that the printing process can be executed. Additionally, if the print subject adjuster determines that the travel distance by which the handy printer is moved is equal to or larger than the second reference distance, the notifier 112 causes the indicator 130 to change the emitted light to the red light, thereby enabling the user to know that the travel distance is larger than the upper limit of the reference travel distance. As a result, the image of the print subject can be printed that is adjusted to prevent the print subject from having too long or too short length in the moving directions. Accordingly, the handy printer 100 of the present embodiment enables the print subject to be easily printed in such a manner that the printed image of the print subject is made to fit the size of an area on which the print subject is to be printed.

Modified Example

Figure 13:
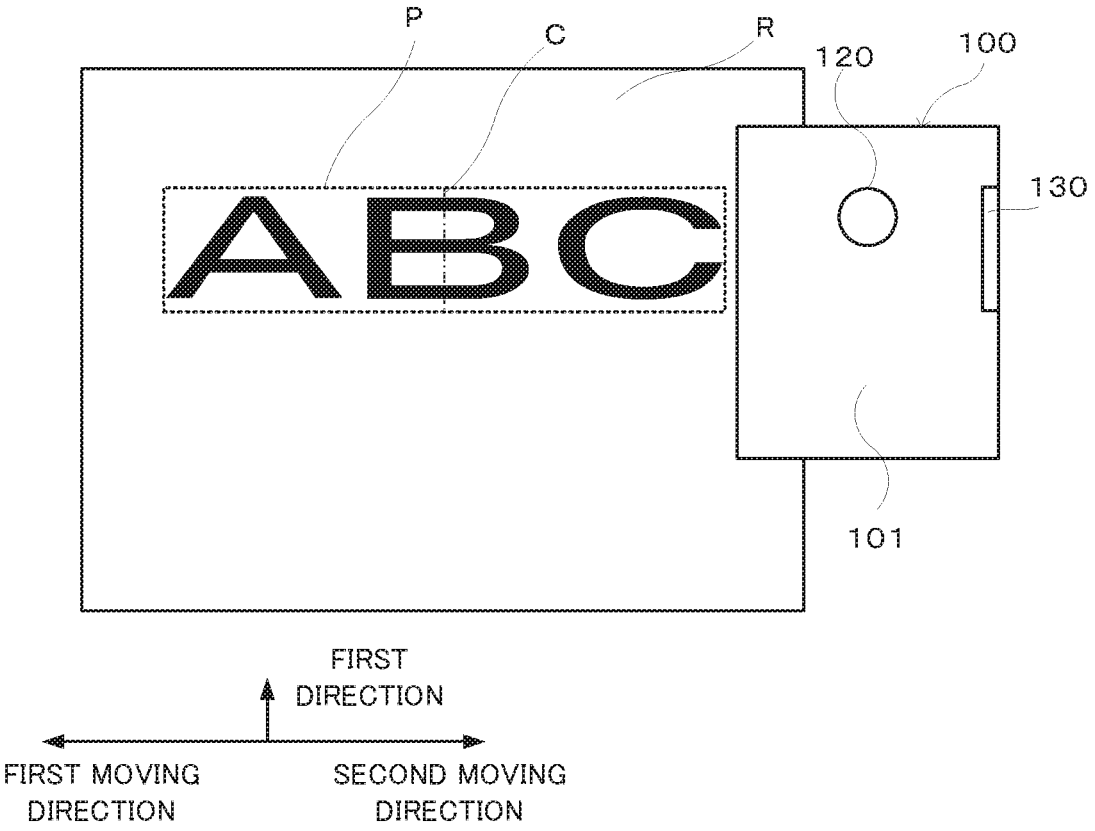
FIG. 13 is a view illustrating the printing processing executed by the handy printer according to the embodiment of the present disclosure.
Figure 14:
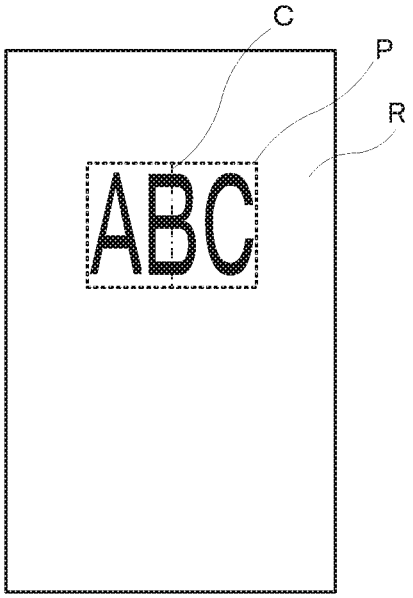
FIG. 14 is a view illustrating a print subject to be printed in a modified example of the present disclosure.

The handy printer 100 according to the above-described embodiment is configured to print an adjusted image of the print subject obtained by blowing up the original image of the print subject in the moving directions because the length of the original image of the print subject in the moving directions is shorter than the length of the printing position P illustrated in FIG. 13 in the moving direction. In contrast, as illustrated in FIG. 14, in a case in which the length of the original image of the print subject in the moving direction is larger than the length of the printing position P in the moving directions, the handy printer 100 is configured to print an adjusted image of the print subject obtained by shrinking the length of the original image of the print subject in the moving direction.

Figure 15:
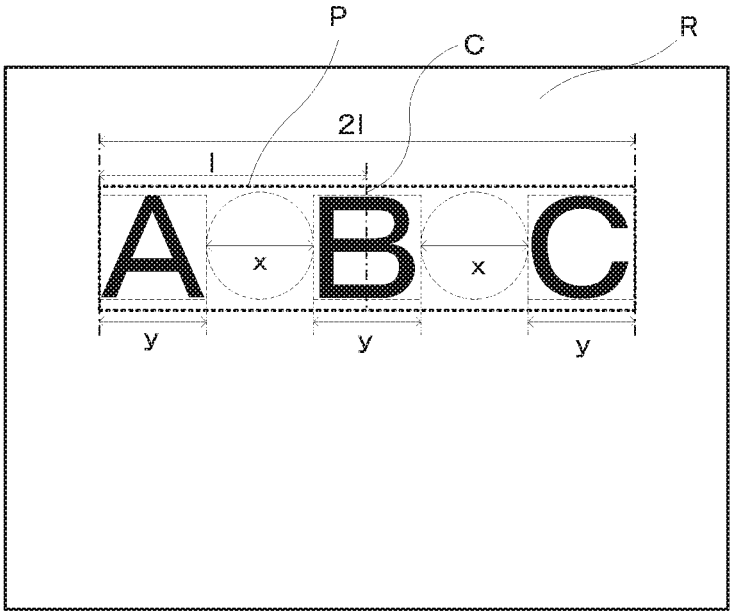
FIG. 15 is a view illustrating a print subject to be printed in the modified example of the present disclosure.

In the handy printer 100 according to the above-described embodiment, the handy printer 100 prints the adjusted image of the print subject obtained by blowing up or shrinking the original image of the print subject in the moving directions. However, the handy printer 100 may be configured to print an image of the print subject obtained by adjusting the original image of the print subject in another manner for making the image of the print subject fit the size of the printing position. For example, as illustrated in FIG. 15, in a case in which the print subject includes letters, the print subject adjuster 113 may be configured to adjust the length of the image of the print subject in the moving directions by lengthening or shortening a distance between the letters. As a result, the length of the image of the print subject in the moving directions can be adjusted without changing the aspect ratio of each of the letters. In this case, when a symbol "l" denotes a length that is one-half of a printing length that is the length of the original image of the print subject in the moving directions, a symbol "x" denotes the distance between the letters, a symbol "y" denotes the sizes of the letters and a symbol "z" denotes the number of the letters, the distance x between the letters is expressed by the following formula.

$$x=(2l-yz)/(z-1)$$

In the above-described case, the printing length is 2l. However, in a case in which printing the print subject is started at a position adjacent to a position at which the indicator 130 is put with the indicator 130 standing still, the length l is equal to the length L1, and the above-described embodiment is a case in which the length l is equal to the length L1.

Figure 16:
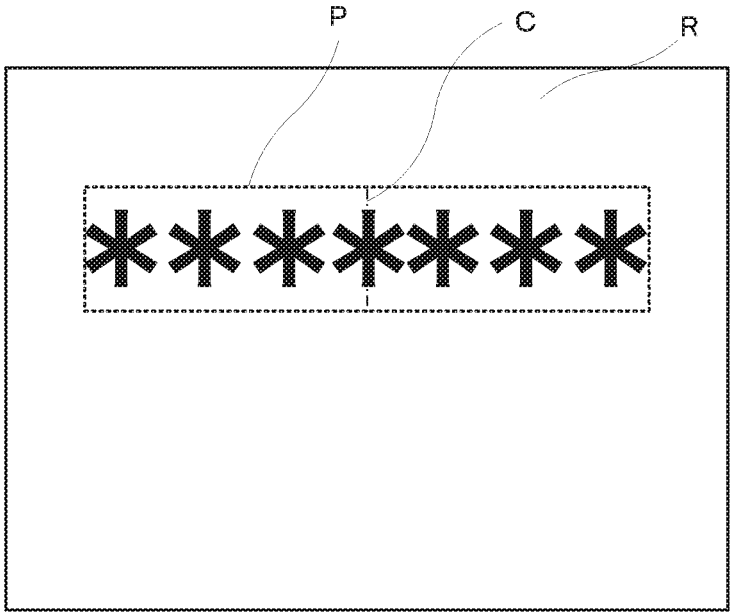
FIG. 16 is a view illustrating a print subject to be printed in the modified example of the present disclosure.
Figure 17:
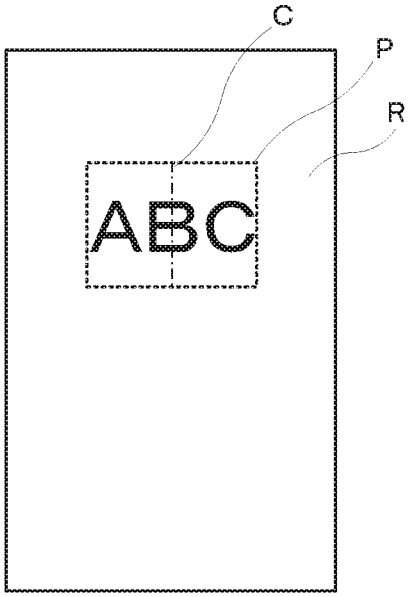
FIG. 17 is a view illustrating a print subject to be printed in the modified example of the present disclosure.

Also, as illustrated in FIG. 16, in a case in which the print subject includes a repeated pattern, the print subject adjuster 113 may be configured to adjust the length of the original image of the print subject in the sub-traveling directions by changing the number of repeats of the repeated pattern. Alternatively, as illustrated in FIG. 17, in a case in which the length of the original image of the print subject in the sub-traveling direction is shrunk, the print subject adjuster 113 may be configured to shrink the original image of the print subject with the aspect ratio of the original image of the print subject kept.

In the handy printer 100 according to the above-described embodiment, the print subject adjuster 113 (i) measures a distance by which the handy printer 100 is moved in the first moving direction from the time when the determination button 120 is pressed to the time when the determination button 120 is pressed again and (ii) defines the measured distance as the reference travel distance. However, the print subject adjuster 113 may be configured to measure the reference travel distance in another manner. For example, the reference travel distance may be determined in accordance with a distance by which the handy printer 100 is moved in the first moving direction until the handy printer 100 remains stationary for or beyond a reference period, is moved in the first moving direction and is stopped to become stationary again for or beyond the reference period. As a result, the reference travel distance can be measured without using the determination button 120.

In the handy printer 100 according to the above-described embodiment, the print subject adjuster 113 adjusts the length of the original image of the print subject in the moving directions so that the adjusted image of the print subject has a length that is two times the reference travel length in the moving directions. However, the print subject adjuster 113 may be configured to adjust the original image of the print subject in another manner enabling the handy printer 100 to easily print an adjusted image of the print subject that fits the size of the area on which the print subject is to be printed. For example, the print subject adjuster 113 may be configured to adjusts the length of the original image of the print subject in the sub-traveling directions so that the adjusted image of the print subject has a length that is larger than the reference travel distance and that is not larger than a length four times the reference travel distance.

In the handy printer 100 according to the above-described embodiment, the first reference distance is set to a length that is one fourth the initial distance, and the second reference distance is set to be equal to the initial distance. However, any distances may be used as the first reference distance and the second reference distance if these distances enable the print subject to be printed without causing a printed image of the print subject to have a length that is too small or too large in the moving directions is avoided. For example, the first reference distance may be equal to or larger than a distance one tenth the initial length and be equal to or less than the initial length, and the second reference distance may be equal to or larger than a distance one half the initial length and be equal to or less than a distance two times the initial length.

Figure 18:
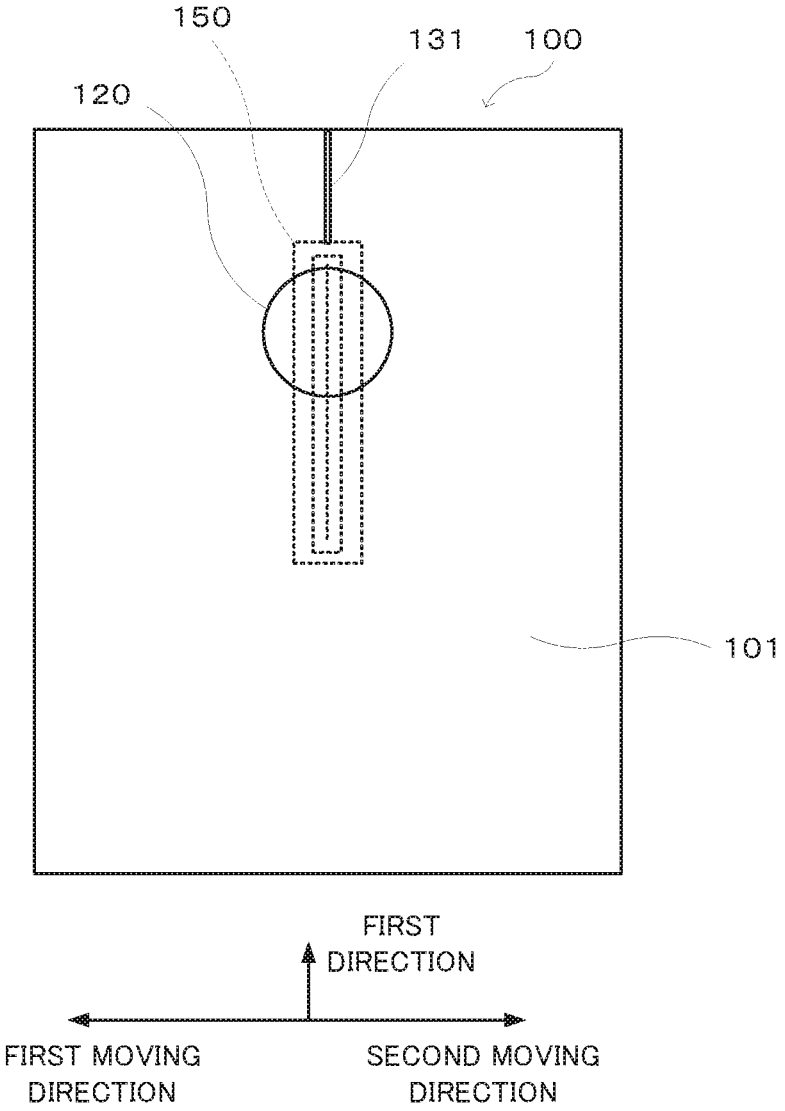
FIG. 18 is a top view illustrating a handy printer according to the modified example of the present disclosure.

In the handy printer 100 according to the above-described embodiment, the indicator 130 disposed on the end portion of the housing 101 represents a reference position that corresponds to the central portion of the print subject in the moving directions during the process of printing the print subject. However, the handy printer 100 may includes any marks indicating the reference position corresponding to the central portion of the print subject in the moving direction. For example, as illustrated in FIG. 18, the handy printer may include a reference position mark 131 indicating the reference position corresponding to the central portion of the print subject in the moving directions. In this example, the reference position mark 131 is arranged on the central portion of the housing 101 in the moving directions.

In the handy printer 100 according to the above-described embodiment is a case in which the notifier 112 uses light emitted by the indicator 130 to notify the user that the handy printer is moved by a distance equal to or larger than the first reference distance or the second reference distance. However, the notifier 112 may be configured to use another manner to notify the user that the handy printer is moved by the distance equal to or larger than the first reference distance or the second reference distance. For example, the notifier 112 may be configured to speak to the user to notify the user that the handy printer is moved by the distance equal to or larger than the first reference distance or the second reference distance.

In the handy printer 100 according to the above-described embodiment, the sensor 140 includes the light source such as an LED and the optical sensor. However, the light source of the sensor 140 is not limited to LEDs configured to emit light having a wavelength included in the visible light region. Light sources used for the sensor 140 include LEDs configured to emit light having a wavelength included in the infrared wavelength region and LEDs configured to emit light having a wavelength included in the ultraviolet wavelength region. For example, the light source of the sensor 140 may be a device configured to emit laser light, a cold cathode fluorescent tube or the like. Additionally, the sensor 140 may include a roller or a ball disposed on the bottom surface of the housing 101 and may be configured to measure the travel distance by measuring the rotation of the roller or ball.

In the above-described embodiment, the initial length calculator 212 of the terminal device 200 calculates the initial length of the print subject. However, the initial length may be calculated by the print subject adjuster 113 of the handy printer 100.

In the above-described embodiment, the printer head 150 ejects black ink from the nozzles. However, the printer head 150 may have any structure for printing the print subject and may be configured to eject two or more kinds of ink. For example, the printer head 150 may be configured to include a magenta-color printer head section to eject magenta-color ink, a cyan-color printer head section to eject cyan-color ink, and a yellow-color printer head section to eject yellow-color ink. In this case, a colored print subject can be printed. Also, in the above-described embodiment, the printer head 150 is of an ink jet type with linearly arranged nozzles. However, the printer head 150 may be configured to have another structure for printing the print subject and may be of a thermal type or another type. Additionally, in the above-described embodiment, the printer head 150 includes the n nozzles that are arranged in a line in the first direction. However, the nozzles of the printer head 150 may be arranged in any manner enabling the print subject to be printed. The nozzles of the printer head 150 is preferably arranged in such a manner that the arrangement of the nozzles appears to be an approximately linear arrangement such as zigzag arrangement shaped like a lightning in the first direction.

In the above-described embodiment is a case in which the adjusted image of the print subject is printed from left to right. However, the handy printer 100 may be configured to print the print subject from right to left, the first sub-traveling direction illustrated in FIG. 1 may be a direction in which the handy printer is moved for printing the print subject, and the second moving direction illustrated in FIG. 1 may be a direction opposite to the first moving direction, that is, a direction in which the handy printer is moved for measuring the reference travel distance. Alternatively, there is no need to fix a direction in which the handy printer is moved for printing the print subject, one of the moving directions in which the handy printer is first moved may be a direction in which the handy printer is moved for measuring the reference distance, and the other of the moving directions may be a direction in which the handy printer is moved for printing the print subject. Alternatively, the handy printer 100 may be configured to print the print subject without measurement of the reference travel distance and without adjustment of the image of the print subject accompanied by the measurement of the reference travel distance.

In the above-described embodiment, the moving directions are perpendicular to the first direction. However, the moving direction has only to intersect the first direction in the handy printer 100 configured to print the print subject, and thus the present disclosure is not limited to the case in which the moving directions are perpendicular to the first direction.

A main part of the transmission process and the printing process performed by the handy printer 100 and the terminal device 200, both of which include the CPU, the RAM, and the ROM, may be realized not by a dedicated system, but can be executed using a general personal digital assistant (a smartphone, a tablet PC, etc.), a personal computer, or the like, without use of a dedicated system. For example, an information terminal that executes the aforementioned processes may be realized by storing a computer program for executing the aforementioned operations in a computer-readable recording medium, such as a flexible disc, a compact disc read only memory (CD-ROM), a digital versatile disc read only memory (DVD-ROM), for distribution and installing the computer program into the personal digital assistant or the like. An information processing device may be configured, for example, by the general personal digital assistant or the like downloading the computer program stored in a storage included in a server device on a communication network, such as the Internet.

For example, in a case in which the functions of the handy printer 100 and the terminal device 200 are shared by an operating system (OS) and an application program or performed in cooperation between the OS and the application program, just the application program of those may be stored in a recording medium or a storage device.

The computer program may be superimposed on a carrier wave, and then may be distributed via a communication network. For example, this computer program may be posted to a bulletin board system (BBS) on a communication network, and may be distributed via the network. Then the computer program may be started and executed under control of an OS in the same manner as other application programs to execute the aforementioned processes.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A printer comprising:

a printer head comprising printing components that are arranged in a line in a first direction;

a sensor to acquire data with respect to a distance by which the printer is moved in one of moving directions that intersect the first direction; and a processor configured (i) to adjust a length of an image of a print subject in the moving directions so that the image of the print subject has a length two times a reference travel distance, the reference travel distance being based on a distance acquired by the sensor, the distance acquired by the sensor being a distance by which the printer is moved from a starting position in a first moving direction of the moving directions, and (ii) to control the printer head in such a manner that, when the printer is moved in a second moving direction of the moving directions that is opposite to the first moving direction, the printer is made to print the adjusted image.

2. The printer according to claim 1, wherein the processor adjusts a position of the image of the print subject so that a center of the image of the print subject in the moving directions is the starting position.

3. The printer according to claim 1, wherein the printer further comprises a determination button, and the processor determines the reference travel distance based on the distance from the starting position, the distance from the starting position being acquired by the sensor when the printer is moved from a time when the determination button is pressed at the starting position to a time when the determination button is pressed again.

4. The printer according to claim 1, wherein the processor determines the reference travel distance based on the distance from the starting position, the distance from the starting position being acquired by the sensor when the printer is moved from a time when the printer remains stationary for or beyond a reference period to a time when the printer remains stationary again for or beyond the reference period.

5. The printer according to claim 1, wherein in a case in which the print subject includes letters, the processor, by increasing or decreasing a distance between the letters, adjusts at least one of (i) a printing area of the image of the print subject in the moving directions, (ii) a printing position of the image in the moving directions, and (iii) a size of the image in the moving directions.

6. The printer according to claim 1, wherein in a case in which the print subject includes a repeated pattern, the processor adjusts the length of the image of the print subject in the moving directions by changing a number of repeats of the repeated pattern.

7. The printer according to claim 1, further comprising a notifier to notify a user of an operation state of the printer, wherein the notifier notifies the user that the print subject is printable when the reference travel distance is larger than a first reference distance.

8. The printer according to claim 7, wherein the notifier notifies the user that the reference travel distance is larger than an upper limit value when the reference travel distance is larger than a second reference distance that is larger than the first reference distance.

9. The printer according to claim 8, wherein in a case in which the reference travel distance is larger than the second reference distance, the second reference distance is set to the reference travel distance.

10. A printing method using a printer including (i) a printer head including printing components that are arranged in a line in a first direction and (ii) a sensor for acquiring data with respect to a distance by which the printer is moved in one of moving directions that intersect the first direction, the printing method comprising:

adjusting a length of an image of a print subject in the moving directions so that the image of the print subject has a length two times a reference travel distance, the reference travel distance being based on a distance acquired by the sensor, the distance acquired by the sensor being a distance by which the printer is moved from a starting position in a first moving direction of the moving directions; and controlling the printer head in such a manner that, when the printer is moved in a second moving direction of the moving directions that is opposite to the first moving direction, the printer is made to print the adjusted image of the print subject at the adjusted position of the image of the print subject.

11. The printing method according to claim 10, wherein a position of the image of the print subject is adjusted so that a center of the image of the print subject in the moving directions is the starting position.

12. The printing method according to claim 10, wherein the printer further includes a determination button, and the reference travel distance is determined based on the distance from the starting position, the distance from the starting position being acquired by the sensor when the printer is moved from a time when the determination button is pressed at the starting position to a time when the determination button is pressed again.

13. The printing method according to claim 10, wherein in a case in which the print subject includes letters, at least one of (i) a printing area of the image of the print subject in the moving directions, (ii) a printing position of the image in the moving directions, and (iii) a size of the image in the moving directions is adjusted by increasing or decreasing a distance between the letters.

14. The printing method according to claim 10, wherein in a case in which the print subject includes a repeated pattern, the length of the image of the print subject in the moving directions is adjusted by changing a number of repeats of the repeated pattern.

15. A non-transitory recording medium storing a program for controlling a printer including (i) a printer head including printing components that are arranged in a line in a first direction and (ii) a sensor for acquiring data with respect to a distance by which the printer is moved in one of moving directions that intersect the first direction, the program causing a computer to:

adjust a length of an image of a print subject in the moving directions so that the image of the print subject has a length two times a reference travel distance, the reference travel distance being based on a distance acquired by the sensor, the distance acquired by the sensor being a distance by which the printer is moved from a starting position in a first moving direction of the moving directions; and control the printer head in such a manner that, when the printer is moved in a second moving direction of the moving directions that is opposite to the first moving direction, the printer is made to print the adjusted image of the print subject at the adjusted position of the image of the print subject.

16. The non-transitory recording medium according to claim 15, wherein a position of the image of the print subject is adjusted so that a center of the image of the print subject in the moving directions is the starting position.

17. The non-transitory recording medium according to claim 15, wherein the printer further includes a determination button, and the reference travel distance is determined based on the distance from the starting position, the distance from the starting position being acquired by the sensor when the printer is moved from a time when the determination button is pressed at the starting position to a time when the determination button is pressed again.

18. The non-transitory recording medium according to claim 15, wherein in a case in which the print subject includes letters, at least one of (i) a printing area of the image of the print subject in the moving directions, (ii) a printing position of the image in the moving directions, and (iii) a size of the image in the moving directions is adjusted by increasing or decreasing a distance between the letters.

19. The non-transitory recording medium according to claim 15, wherein in a case in which the print subject includes a repeated pattern, the length of the image of the print subject in the moving directions is adjusted by changing a number of repeats of the repeated pattern.

* * * * *